US005262044A

United States Patent [19]

Huizinga et al.

[11] Patent Number: 5,262,044

[45] Date of Patent: Nov. 16, 1993

[54] PROCESS FOR UPGRADING A HYDROCARBONACEOUS FEEDSTOCK AND APPARATUS FOR USE THEREIN

[75] Inventors: Tom Huizinga; Gerardus L. B. Thielemans, both of The Hague, Netherlands

[73] Assignee: Shell Oil Company, Houston, Tex.

[21] Appl. No.: 941,458

[22] Filed: Sep. 8, 1992

[30] Foreign Application Priority Data

Oct. 1, 1991 [GB] United Kingdom ..... 9120776

[51] Int. Cl.[5] ..... C10G 47/00; C10G 47/22

[52] U.S. Cl. ..... 208/107; 208/108; 208/112

[58] Field of Search ..... 208/107, 108, 112

[56] References Cited

U.S. PATENT DOCUMENTS 3,124,526 3/1964 Butler et al. .
3,595,779 7/1971 Peck et al. .
4,194,964 3/1980 Chen et al. .
4,213,847 7/1980 Chen et al. .
4,389,301 6/1983 Dohlberg et al. ..... 208/108
4,624,748 11/1986 Haunschild .
4,659,452 4/1987 Howell ..... 208/107
4,990,242 2/1991 Louie et al. .
5,082,551 1/1992 Reynolds et al. ..... 208/112

FOREIGN PATENT DOCUMENTS 913005 10/1972 Canada .
1087309 8/1960 Fed. Rep. of Germany .
208454A 5/1984 Fed. Rep. of Germany .
1323257 7/1973 United Kingdom .

*Primary Examiner*—Marianne M. Cintins
*Assistant Examiner*—John Peabody

[57] ABSTRACT

A process for upgrading a hydrocarbonaceous feedstock which process included separating the feedstock in the presence of hydrogen at elevated temperature and a partial hydrogen pressure greater than 50 bar into a high boiling fraction and a low boiling fraction and subjecting at least part of the low boiling fraction substantially boiling in the gasoline range to a hydrotreating step under substantially the same conditions as prevailing in the separation step, and recovering from the hydrotreating step a product substantially boiling in the gasoline range and being of improved quality.

11 Claims, No Drawings

PROCESS FOR UPGRADING A HYDROCARBONACEOUS FEEDSTOCK AND APPARATUS FOR USE THEREIN

FIELD OF THE INVENTION

The present invention relates to a process for upgrading a hydrocarbonaceous feedstock and an apparatus to be used in such a process. In particular, the present invention relates to a process for upgrading a hydrocarbonaceous feedstock which has been derived from a hydrocracking process.

BACKGROUND OF THE INVENTION

In view of the increasing tendency in refineries to convert heavy feedstocks into light products having enhanced quality, various product streams, such as hydroprocessing product streams, require further processing before they can satisfactory meet the present day stringent requirements for high octane, low sulfur and low aromatics content.

Quality improvement of some of these hydrocarbonaceous products may be carried out by catalytic reforming with, for instance, platinum-containing reforming catalysts. However, the presence of sulfur- and nitrogen-containing compounds in the reformer feedstock reduces the performance of such catalysts and removal of these compounds by catalytic hydrotreatment is thus considered necessary prior to reforming in order to ensure sufficient catalyst life time with consequent increase in cost.

A process producing various hydrocarbonaceous products which may require further upgrading is hydrocracking. Hydrocracking is a well-established process in which heavy hydrocarbons are contacted in the presence of hydrogen with a hydrocracking catalyst. The temperature and the pressure are relatively high, so that the heavy hydrocarbons are cracked to products with a lower boiling point. Although the process can be carried out in one stage, it has been shown to be advantageous to carry out the process in a plurality of stages. In a first stage the feedstock is subjected to denitrogenation, desulfurization and hydrocracking, and in a second stage most of the hydrocracking reactions occur.

A low boiling fraction substantially boiling in the gasoline range is obtained from the total hydrocracking product by fractionation following one or more separation steps. Subsequently, the low boiling fraction substantially boiling in the gasoline range and containing an unacceptable amount of sulfur-containing compounds is subjected to a separate hydrotreating step to remove these contaminants from this fraction before the fraction is subjected to a reforming step. The conditions under which the hydrotreating step is carried out differ considerably from those applied in the separation/fractionation steps.

It would be advantageous to have a process in which the separation and hydrotreating step are carried out under substantially the same conditions.

SUMMARY OF THE INVENTION

It has now been found that a heavy hydrocarbonaceous feedstock can be upgraded to produce a low boiling fraction if both the separation step of the low boiling fraction and the hydrotreating step to remove contaminants in the low boiling fraction are carried out in the presence of hydrogen under substantially the same conditions.

Accordingly, an aspect of the present invention is a process for upgrading a hydrocarbonaceous feedstock which process is separating the feedstock in the presence of hydrogen at elevated temperatures and in the presence of an alumina-containing catalyst into a high boiling fraction and a low boiling fraction substantially boiling in the gasoline range and subjecting at least part of the low boiling fraction to a hydrotreating step under substantially the same conditions as prevailing in the separation step, and recovering from the hydrotreating step a product substantially boiling in the gasoline range and of improved quality.

DETAILED DESCRIPTION OF THE INVENTION

An aspect of the present invention is a process for upgrading a hydrocarbonaceous feedstock which includes separating the feedstock in the presence of hydrogen at elevated temperature and a partial hydrogen pressure greater than 50 bar into a high boiling fraction and a low boiling fraction substantially boiling in the gasoline range and subjecting at least part of the low boiling fraction to a hydrotreating step under substantially the same conditions as prevailing in the separation step, and recovering from the hydrotreating step a product substantially boiling in the gasoline range and being of improved quality, i.e., reduced contaminants. In this way hydrocarbonaceous products of a high quality are obtained, while the separation and hydrotreating step are advantageously connected in such a way that an optimum heat integration can be obtained and the application of expensive reactor equipment can be reduced.

The hydrocarbonaceous feedstock to be upgraded has been derived from a hydroconversion process, preferably from a hydrocracking process, i.e., a hydrocrackate. A low boiling fraction is formed and removed by a separation step carried out at a temperature between 200° and 400° C., or preferably, between 250° and 350° C. The partial hydrogen pressure is up to 250 bar, or preferably, between 100 and 200 bar. In the process according to the present invention space velocities can be applied between 1 and 20 kg/l/h, preferably between 2 and 10 kg/l/h.

Preferably, the process according to the present invention is carried out in such a way that the separating step and the hydrotreating step are integrated. These steps are preferably carried out in the same apparatus.

Although it is preferred that the hydrotreating step is directed to the removal of sulfur- and nitrogen-containing compounds by way of catalytic hydrotreatment, it should be noted that the hydrotreating step can also suitably be directed to, for instance, the removal of aromatics by means of catalytic hydrogenation.

In the event that the hydrotreating step is directed to the catalytic removal of sulfur- and nitrogen-containing compounds used are made of an alumina-containing catalyst, for instance a silica-alumina-containing catalyst having both desulfurization and nitrogenation activity. Use is made of a metal-containing alumina catalyst, whereby the metal is at least one of the Group VIB and/or Group VIII metals. Preferably, at least one of the metals is Ni, Co, W or Mo. The catalysts which can suitably be applied to remove sulfur- and nitrogen-containing compounds are commercially available catalysts and can be prepared by methods known in the art.

In the event that the hydrotreating step is directed to the removal of aromatics suitably use is made of a catalyst bringing about substantial hydrogenation of the low boiling fraction substantially boiling in the gasoline fraction. Catalysts for removal of aromatics are the same as those described above.

In a preferred embodiment of the present invention the high boiling fraction is contacted in counter-current flow operation with additional hydrogen or a hydrogen-containing gas, preferably pure hydrogen, during the separation step. In this way a very sharp separation can be established between the low boiling fraction substantially boiling in the gasoline range and the high boiling fraction. Moreover, also sulfur- and nitrogen-containing compounds such as $H_2S$ and $NH_3$ can advantageously be stripped from the high boiling fraction resulting in a high boiling fraction being of enhanced quality. In operation the hydrogen-containing gas can suitably be supplied to the separation vessel by means of inlet means arranged in the bottom section of the vessel. In order to facilitate the separation even further the bottom section of the separation vessel can be provided with contacting means, for instance contacting trays.

In a more preferred embodiment of the present invention the high boiling fraction is first contacted in counter-current flow operation with additional hydrogen or a hydrogen-containing gas during the separation step. Subsequently, at least part of the high boiling fraction recovered is contacted with hydrogen under conditions causing substantial hydrogenation using a catalyst comprising at least one Group VIII noble metal(s) on a support.

Supports include alumina, silica-alumina and zeolitic materials such as zeolite Y. Preferably, the catalyst contains a support which contains a Y-type zeolite. More preferably, the support comprises a modified Y-type zeolite having a unit cell size between 24.20 and 24.30 Å, in particular between 24.22 and 24.28 Å, and a $SiO_2/Al_2O_3$ molar ratio of at least 25, in particular above 35 and preferably between 35 and 60. Suitably, use is made of a catalyst support obtained by dealuminating a Y-type zeolite. The Group VIII noble metals to be used in this specific embodiment of the present invention are ruthenium, rhodium, palladium, osmium, iridium and platinum. Very good results are obtained with platinum and with combinations of platinum and palladium. The use of catalysts containing both platinum and palladium is preferred. The noble metals are suitably applied in amounts between 0.05 and 3 %w on support material. Preferably amounts are used in the range of 0.2 and 2 %,,w on support material. When two noble metals are applied the aggregate amount of the two metals normally ranges between 0.5 and 3 %w on support material. When platinum and palladium are used as the noble metals normally a platinum/palladium molar ratio of 0.25–0.75 is applied. The catalysts optionally contain a binder material such as alumina and silica, preferably alumina. The noble metal(s) catalysts to be applied in this way can be prepared by methods known in the art. Regeneration of the catalysts is by conventional means.

In this way substantially unsaturated moieties such as olefinic compounds and in particular aromatic compounds present in the high boiling fraction are converted into the corresponding saturated compounds resulting in a high boiling fraction of enhanced quality.

When the hydrocarbonaceous feedstock to be upgraded is derived from a hydrocracking process the high boiling fraction contains a kerosene, a gas oil and a residual fraction. Suitably, at least part of the residual fraction is recycled to the hydrocracking stage. It is preferred to recycle the complete residual fraction to the hydrocracking stage. This has the advantage that the complete hydrocracker feedstock is converted to products with a lower boiling point.

When kerosenes are hydrogenated in the above described manner the smoke points are improved considerably and when gas oils are processed in this way the cetane numbers are increased substantially. Moreover, the amount of polynuclear aromatic compounds present in the high boiling fraction can advantageously be reduced and thus fouling of the equipment applied can be prevented. Moreover, by the above described process build-up of polynuclear aromatics in the recycle stream to the hydrocracking stage is also prevented. Further, it should be noted that such a mode of operation enables the application of an advantageously mild pressure in the hydrocracking stage.

The hydrogenation of the high boiling fraction is normally carried out at a temperature between 150° and 400° C., preferably between 200° and 350° C. The partial hydrogen pressure to be applied ranges are between 20 and 250 bar, preferably between 25 and 200 bar, and most preferably between 30 and 150 bar. Space velocities between 0.05 and 5 kg/l/h can be applied, preferably between 0.4 and 1.5 kg/l/h. Hydrogen/feedstock ratios (Nl/kg) between 200 and 2000 can be applied, preferably between 400 and 1500. As a hydrogen source use can be made of pure hydrogen or of hydrogen-containing mixtures for instance the gases produced in catalytic reforming processes.

The present invention further relates to an apparatus for carrying out the process according to the present invention which apparatus includes a vessel having inlet means for the hydrocarbonaceous feedstock and hydrogen, outlet means for the high boiling fraction in the bottom section of the vessel outlet means for the low boiling fraction in the upper section of the vessel, and a catalyst bed for carrying out the hydrotreating step arranged in the upper section of the vessel.

Preferably, the apparatus to be applied in the present process includes inlet means arranged in the bottom section of the separator vessel for introducing hydrogen or hydrogen-containing gas which is to be contacted with the high boiling fraction during the separating step. The bottom section of the apparatus is further provided with contacting means, for instance contacting trays, to improve the separating step even more.

What is claimed is:

1. A process for upgrading a hydrocarbonaceous feedstock which process comprises separating the feedstock in the presence of hydrogen at a temperature between about 200° C. and about 314° C. and a partial hydrogen pressure greater than about 50 bar into a high boiling fraction and a low boiling fraction, wherein the separation is conducted in the absence of a catalyst; and subjecting at least part of the low boiling fraction substantially boiling in the gasoline range to a hydrotreating step under substantially the same conditions as those of the separation step, and recovering from the hydrotreating step a product substantially boiling in the gasoline range and being of improved quality.

2. The process according to claim 1, wherein the hydrocarbonaceous feedstock is derived from a hydrocracking process.

3. The process according to claim 2, wherein the separation is carried out at a partial hydrogen pressure up to about 250 bar.

4. The process according to claim 3, wherein the separation is carried out at a partial hydrogen pressure between about 100 bar and about 200 bar.

5. The process according to claim 3, wherein in the hydrotreating step an alumina-containing catalyst is applied.

6. The process according to claim 5, wherein said alumina-containing catalyst contains one of the Group VIb and/or VIII metals.

7. The process according to claim 6, wherein the metal is at least one of Ni, Mo, W or Co.

8. The process according to claim 2, wherein the separation step and the hydrotreating step are integrated.

9. The process according to claim 3 wherein during the separation the high boiling fraction is contacted in counter-current flow operation with additional hydrogen or a hydrogen-containing gas.

10. The process according to claim 9, wherein at least part of the high boiling fraction recovered is subsequently contacted with hydrogen under conditions causing substantial hydrogenation using a catalyst comprising one or more Group VIII noble metal on a support.

11. A process for upgrading a hydrocarbonaceous hydrocrackate feedstock which process comprises (a) separating the feedstock in the presence of hydrogen, at a temperature between about 250° C. and about 314° C. and a partial hydrogen pressure between about 100 bar and about 200 bar, into a high boiling fraction and a low boiling fraction, wherein the separation is conducted in the absence of a catalyst (b) hydrotreating at least part of the low boiling fraction substantially boiling in the gasoline range, wherein the separation step and the hydrotreating step are integrated, wherein said hydrotreating comprises contact with a catalyst containing alumina and at least one of Ni, Mo, W or Co under substantially the same conditions as in the separation step, and recovering from the hydrotreating step a product substantially boiling in the gasoline range and being of improved quality.

* * * * *